US006568909B2

(12) United States Patent
Szucs et al.

(10) Patent No.: US 6,568,909 B2
(45) Date of Patent: May 27, 2003

(54) METHODS AND APPARATUS FOR IMPROVING ENGINE OPERATION

(75) Inventors: Peter Nicholas Szucs, West Chester, OH (US); Gregory Scott McNulty, Shelbyville, IN (US); Syed Arif Khalid, Indianapolis, IN (US); David William Crall, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/964,019

(22) Filed: Sep. 26, 2001

(65) Prior Publication Data

US 2003/0059309 A1 Mar. 27, 2003

(51) Int. Cl.[7] ..... F01D 5/20
(52) U.S. Cl. ..... 416/228; 29/889.7
(58) Field of Search ..... 29/889.7; 416/228, 416/97 R

(56) References Cited

U.S. PATENT DOCUMENTS 4,497,613 A * 2/1985 Carreno ..... 416/228
4,589,824 A 5/1986 Kozlin
5,261,789 A 11/1993 Butts et al.
6,164,914 A 12/2000 Correia et al.
6,179,556 B1 1/2001 Bunker

* cited by examiner

*Primary Examiner*—Edward K. Look
*Assistant Examiner*—Kimya N McCoy
(74) *Attorney, Agent, or Firm*—Nathan D. Herkamp; Armstrong Teasdale LLP; Robert B. Reeser, III

(57) ABSTRACT

An airfoil for a gas turbine engine includes a leading edge, a trailing edge, a tip plate, a first sidewall, and a second sidewall. The first sidewall extends in radial span between an airfoil root and the tip plate. Furthermore, the first sidewall defines a pressure side of the airfoil. The second sidewall is connected to the first sidewall at the leading and trailing edges, and extends in radial span between the airfoil root and the tip plate. The second sidewall defines a suction side of the airfoil. The tip plate includes at least one groove that extends substantially between the first and second sidewalls.

20 Claims, 4 Drawing Sheets

METHODS AND APPARATUS FOR IMPROVING ENGINE OPERATION

BACKGROUND OF THE INVENTION

This invention relates generally to gas turbine engines, and more specifically to rotor blades used with axial gas turbine engines.

Gas turbine engines include a rotor assembly including a row of rotor blades. The blades extend radially outward from a platform that extends between an airfoil portion of the blade and a dovetail portion of the blade. The platform defines a portion of the gas flow path through the engine, and the dovetail couples each rotor blade to the rotor disk. More specifically, each rotor blade extends radially outward from the platform to a tip. A plurality of static shrouds abut together to form flowpath casing that extends circumferentially around the rotor blade assembly, such that a tip clearance is defined between each respective rotor blade tip and the casing or shroud. The tip clearance is tailored to be a minimum, yet is sized large enough to facilitate rub-free engine operation through the range of available engine operating conditions.

During operation, tip leakage across the rotor blade tips may limit the performance and stability of the rotor assembly. To facilitate increasing an efficiency and a stable flow range (a stall margin) at a given clearance for the rotor assembly at least some known rotor assemblies, grooves are machined into the flowpath casing above the rotor tips to facilitate increasing pressure rise and stability of the airflow. Such grooves, known as casing treatments, may have an efficiency penalty that increases with their effectiveness in delaying stall. Additionally, such casing treatments may not reduce the sensitivity of performance and stall margin that may be caused with increased tip clearance levels. To prevent inducing fatigue stresses into the shroud, the shrouds are often fabricated from stronger and thicker materials, and as such, the casing treatments may also increase an overall weight of the rotor assembly.

BRIEF DESCRIPTION OF THE INVENTION

In one aspect of the invention, an airfoil for a gas turbine engine is provided. The airfoil includes a leading edge, a trailing edge, a tip plate, a first sidewall, and a second sidewall. The first sidewall extends in radial span between an airfoil root and the tip plate, and defines a pressure side of the airfoil. The second sidewall is connected to the first sidewall at the leading and trailing edges, and extends in radial span between the airfoil root and the tip plate to define a suction side of the airfoil. The tip plate includes at least one groove that extends substantially between the first and second sidewalls.

In another aspect, a method for fabricating a rotor blade for a gas turbine engine is provided. More specifically, the method facilitates improving an efficiency of the rotor blade. The method includes casting a rotor blade to include a leading edge, a trailing edge, a first sidewall, and a second sidewall, wherein the first and second sidewalls are connected chordwise at the leading and trailing edges, and extend radially between a blade root and a blade tip plate, and forming at least one groove in the tip plate that extends substantially between the first and second sidewalls.

In a further aspect, a gas turbine engine including a plurality of rotor blades is provided. Each of the rotor blades includes an airfoil including a leading edge, a trailing edge, a first sidewall, a second sidewall, and a tip plate. The airfoil first and second sidewalls are connected chordwise at the leading and trailing edges. The first and second sidewalls extend radially from a blade root to the tip plate, and the tip plate includes a groove that extends substantially between the airfoil first and second sidewalls. The groove is for transferring fluid from the first sidewall to the second sidewall.

DETAILED DESCRIPTION OF THE INVENTION

Figure 1:
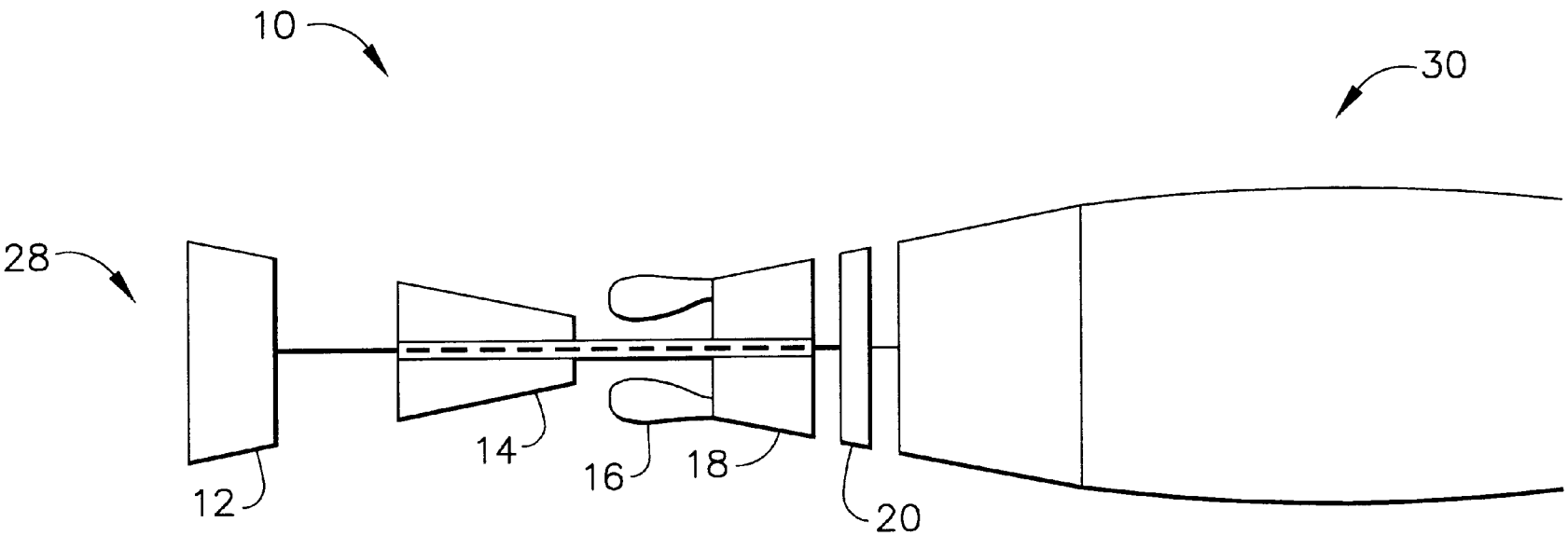
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, and a low pressure turbine 20. Engine 10 has an intake side 28 and an exhaust side 30. In one embodiment, engine 10 is a CF6 engine commercially available from General Electric Company, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12.

Figure 2:
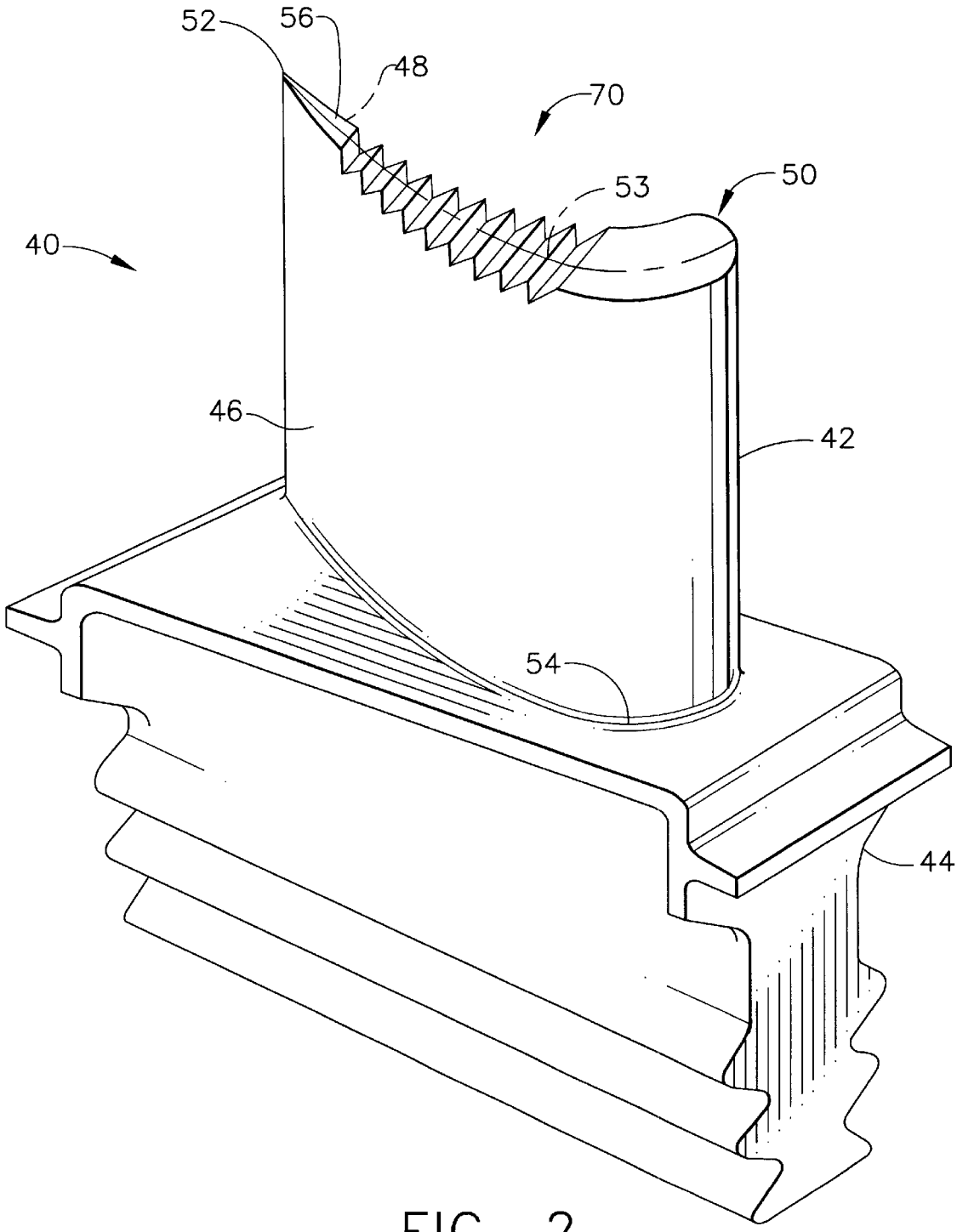
FIG. 2 is a partial perspective view of a rotor blade that may be used with the gas turbine engine shown in FIG. 1.
Figure 3:
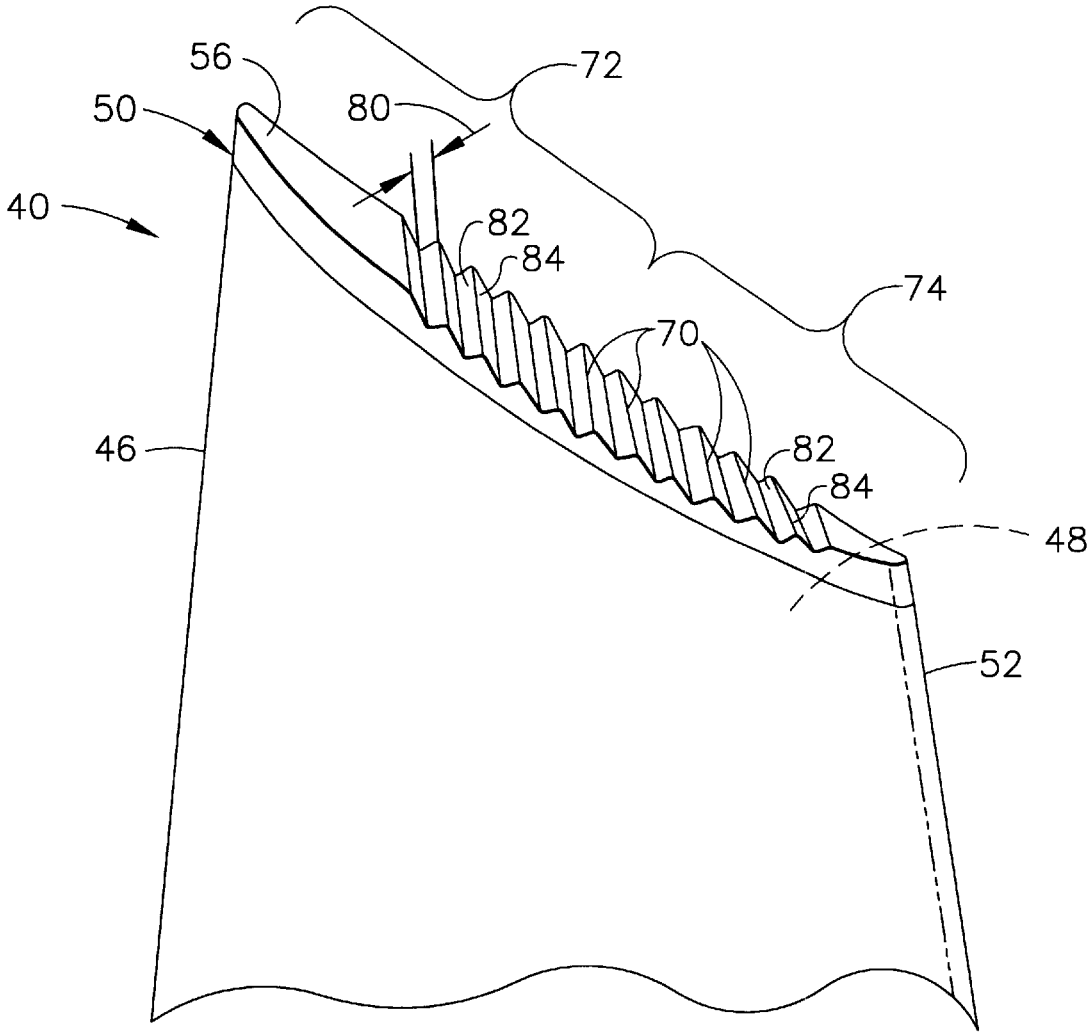
FIG. 3 is an enlarged partial perspective view of the rotor blade shown in FIG. 2.

FIG. 2 is a perspective view of a rotor blade 40 that may be used with a gas turbine engine, such as gas turbine engine 10 (shown in FIG. 1). FIG. 3 is an enlarged partial perspective view of the rotor blade shown in FIG. 2. In one embodiment, a plurality of rotor blades 40 form a high pressure compressor rotor blade stage (not shown) of gas turbine engine 10. Each rotor blade 40 includes an airfoil 42 and an integral dovetail 44 used for mounting airfoil 42 to a rotor disk (not shown) in a known manner. Alternatively, blades 40 may extend radially outwardly from an outer rim (not shown), such that a plurality of blades 40 form a blisk (not shown).

Each airfoil 42 includes a first sidewall 46 and a second sidewall 48. First sidewall 46 is convex and defines a suction side of airfoil 42, and second sidewall 48 is concave and defines a pressure side of airfoil 42. Sidewalls 46 and 48 are joined at a leading edge 50 and at an axially-spaced trailing edge 52 of airfoil 42. Airfoil trailing edge 52 is spaced chordwise and downstream from airfoil leading edge 50. A blade chord 53 is defined as longitudinally extending between leading and trailing edges 50 and 52, respectively.

First and second sidewalls 46 and 48, respectively, extend longitudinally or radially outward in span from a blade root 54 positioned adjacent dovetail 44 to an airfoil tip plate 56. Tip plate 56 defines a radially outer boundary of airfoil 42. Furthermore, when rotor blades 40 are within the gas turbine engine, a tip clearance is defined between tip plate 56 and a shroud (not shown) or casing (not shown).

Tip plate 56 extends between leading and trailing edges 50 and 52, respectively, and between first and second sidewalls 46 and 48, respectively. In the exemplary embodiment, tip plate 56 includes a plurality of grooves 70 that extend across tip plate 56 between first and second sidewalls 46 and 48. In an alternative embodiment, tip plate 56 includes only one groove 70. In a further embodiment, tip plate 56 includes a leading edge half 72 and a trailing edge half 74, and grooves 70 only extend across tip plate trailing edge half 74.

Grooves 70 are incorporated into tip plate 56 without inducing increased fatigue sensitivity into rotor blade 40. In the exemplary embodiment, grooves 70 are machined into tip plate 56 after blade 40 has been cast. In another embodiment, grooves 70 are formed in tip plate 56 during casting of blade 40. Grooves 70 are not substantially perpendicular to chord 53, but rather are oriented to be inclined between a tangential or blade rotation direction, and a primary flow direction relative to the rotor. In an alternative embodiment, grooves 70 are oriented at different angular orientations with respect to chord 53. In the exemplary embodiment, adjacent grooves 70 are substantially parallel. In an alternative embodiment, adjacent grooves 70 are not substantially parallel.

Each groove 70 defines a substantially V-shaped cross-sectional profile. In an alternative embodiment, each groove 70 defines a non-V-shaped cross-sectional profile. Grooves 70 are identical and each has a depth 80 measured from a bottom 82 of each groove 70 to a top 84 of each groove 70. Groove depth 80 is selected to provide a desired tip clearance that facilitates increasing an efficiency and a stable flow range or stall margin for rotor blades 40. More specifically, in the exemplary embodiment, groove depth 80 is substantially constant across tip plate 56. In another embodiment, adjacent grooves 70 are not identical. In a further embodiment, groove depth 80 is variable across tip plate 56.

During engine operation, as rotor blades 40 rotate, grooves 70 alter the leakage flow distribution along blade chord 53 and the direction of the leakage as fluid passes over blade tip plate 56. More specifically, grooves 70 facilitate increasing the streamwise momentum of fluid flowing therein, thus reducing blockage and losses that may be caused by an interaction between the primary flow, the tip clearance vortex, and the adverse pressure gradient. Imparting additional streamwise momentum also facilitates reducing the portion of leakage flow that may flow from the tip clearance defined by a first blade into a tip clearance defined by an adjacent rotor blade. More specifically, the resulting leakage vortex core which originates near rotor blade leading edge 50, entrains higher energy fluid and experiences less loss and blockage growth. As a result, grooves 70 facilitate increasing an efficiency, and stability of the gas turbine engine compressor. Furthermore, grooves 70 also facilitate reducing the sensitivity to tip clearance of the gas turbine engine compressor.

Figure 4:
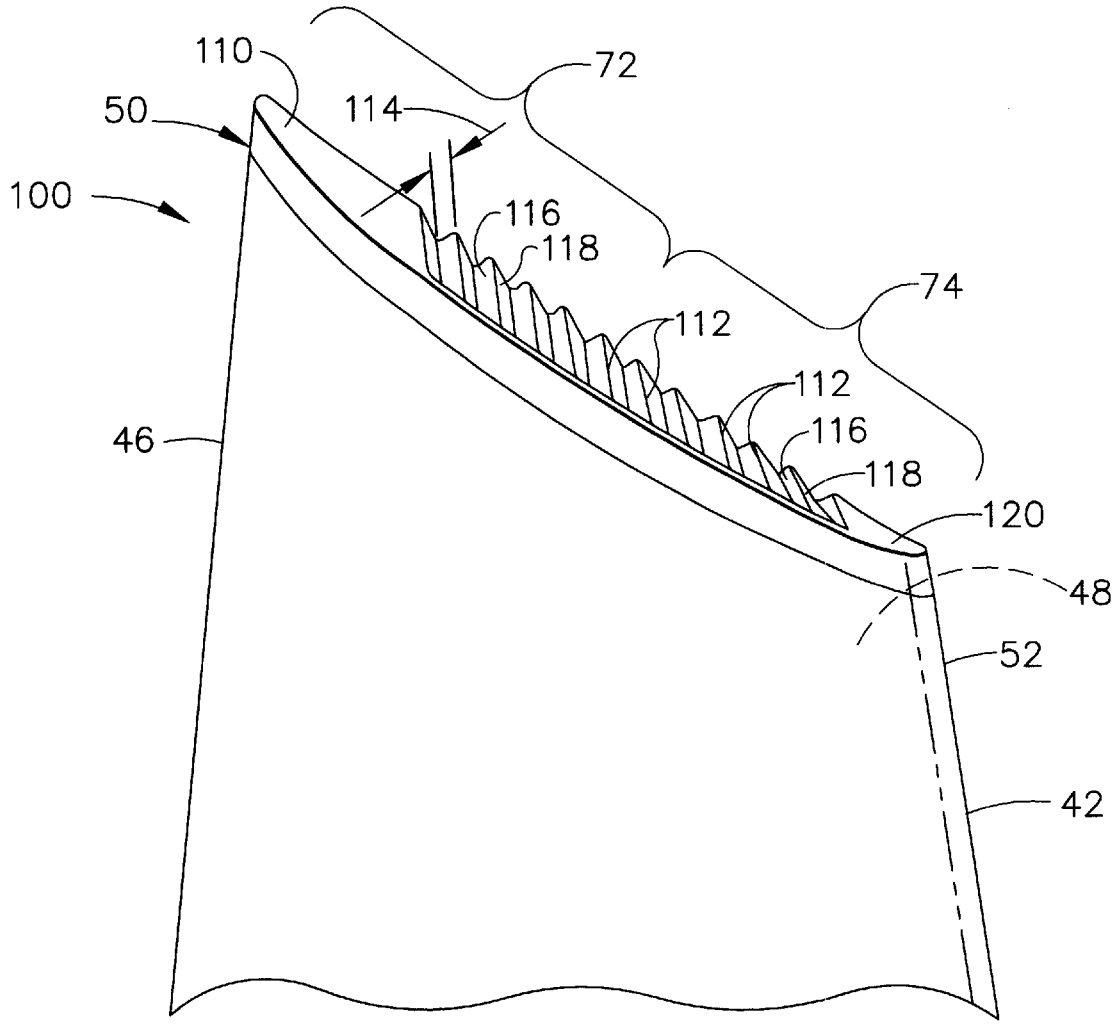
FIG. 4 is an enlarged partial perspective view of a rotor blade that may be used with the gas turbine engine shown in FIG. 1.

FIG. 4 is an enlarged partial perspective view of an exemplary embodiment of a rotor blade 100 that may be used with a gas turbine engine, such as gas turbine engine 10 (shown in FIG. 1). Rotor blade 100 is substantially similar to rotor blade 40 shown in FIGS. 2 and 3, and components in rotor blade 100 that are identical to components of rotor blade 40 are identified in FIG. 4 using the same reference numerals used in FIGS. 2 and 3. Accordingly, rotor blade 100 includes airfoil 42, sidewalls 46 and 48 (shown in FIG. 2) extending between leading and trailing edges 50 and 52, respectively, and dovetail 44 (shown in FIG. 2). Furthermore, rotor blade 100 also includes a tip plate 110 that defines a radially outer boundary of airfoil 42. Furthermore, when rotor blades 100 are within the gas turbine engine, a tip clearance is defined between tip plate 110 and a shroud (not shown) or casing (not shown).

Tip plate 110 extends between leading and trailing edges 50 and 52, respectively, and between first and second sidewalls 46 and 48, respectively. In the exemplary embodiment, tip plate 110 includes a plurality of grooves 112 that extend across tip plate 110 between first and second sidewalls 46 and 48. Grooves 112 are substantially similar to grooves 70 (shown in FIGS. 2 and 3). In an alternative embodiment, tip plate 110 includes only one groove 112. In a further embodiment, tip plate 110 includes leading edge half 72 and trailing edge half 74, and grooves 112 only extend across tip plate trailing edge half 74.

Grooves 112 are incorporated into tip plate 110 without inducing increased fatigue sensitivity into rotor blade 100. In the exemplary embodiment, grooves 112 are machined into tip plate 110 after blade 40 has been cast. In another embodiment, grooves 112 are formed in tip plate 110 during casting of blade 100. Grooves 112 are not substantially perpendicular to chord 53 (shown in FIG. 2), but rather are oriented to be inclined between a tangential or blade rotation direction, and a primary flow direction relative to the rotor. In an alternative embodiment, grooves 112 are oriented at different angular orientations with respect to chord 53. In the exemplary embodiment, adjacent grooves 112 are substantially parallel. In an alternative embodiment, adjacent grooves 112 are not substantially parallel.

Each groove 112 defines a substantially V-shaped cross-sectional profile. In an alternative embodiment, each groove 112 defines a non-V-shaped cross-sectional profile. Grooves 112 are identical and each has a depth 114 measured from a bottom 116 of each groove 112 to a top 118 of each groove 112. Groove depth 114 is selected to provide a desired tip clearance that facilitates increasing an efficiency and a stable flow range or stall margin for rotor blades 100. More specifically, in the exemplary embodiment, groove depth 114 is tapered across tip plate 110. Accordingly, adjacent sidewall 46, groove depth 114 is approximately equal zero, such that groove bottom 116 is substantially flush with an outer surface 120 of tip plate 110, and a depth 114 of each groove 112 is deepest adjacent sidewall 48. In another embodiment, adjacent grooves 112 are not identical.

During engine operation, as rotor blades 100 rotate, grooves 112 alter the leakage flow distribution along blade chord 53 and the direction of the leakage as fluid passes over blade tip plate 110. More specifically, grooves 112 facilitate increasing the streamwise momentum of fluid flowing therein, thus reducing blockage and losses that may be caused by an interaction between the primary flow, the tip clearance vortex, and the adverse pressure gradient. Imparting additional streamwise momentum also facilitates reducing the portion of leakage flow that may flow from the tip clearance defined by a first blade into a tip clearance defined by an adjacent rotor blade. More specifically, the resulting leakage vortex core which originates near rotor blade leading edge 50, entrains higher energy fluid and experiences less loss and blockage growth. As a result, grooves 112 facilitate increasing an efficiency, and stability of the gas turbine engine compressor. Furthermore, grooves 112 also facilitate reducing the sensitivity to tip clearance of the gas turbine engine compressor.

Exemplary embodiments of rotor blade grooves are described above in detail. The rotor blades are not limited to the specific embodiments described herein, but rather, variations in the grooves of each rotor blade may be utilized independently and separately from the grooves described herein.

The above-described rotor blades are cost-effective, highly reliable, and readily retrofittable. Each rotor blade includes at least one groove that extends across the tip plate between the opposing airfoil sidewalls. The grooves facilitate streamwise momentum exchange between the pressure and suction sides of the airfoil. The increased streamwise momentum of the fluid facilitates reducing blockage and losses caused by the interaction between the primary flow, the tip clearance vortex, and the adverse pressure gradient. As a result, the grooves facilitate increasing the efficiency and stability of the gas turbine engine in a cost effective and reliable manner, while reducing the sensitivity of the gas turbine engine compressor to tip clearance.

While the invention has been described in terms of various specific embodiments, those skilled in the art will recognize that the invention can be practiced with modification within the spirit and scope of the claims.

What is claimed is:

1. A method for fabricating tip end configuration for a rotor blade of a gas turbine engine to facilitate improving efficiency of the rotor blade, said method comprising:

forming a rotor blade to include a leading edge, a trailing edge, a first sidewall, and a second sidewall, wherein the first and second sidewalls are connected chordwise at the leading and trailing edges, and extend radially between a blade root and a blade tip plate, wherein the tip plate extends substantially between the leading and trailing edges; and forming at least one groove in the tip plate to extend substantially between the first and second sidewalls.

2. A method in accordance with claim 1 wherein forming at least one groove further comprises forming at least one groove in the tip plate for increasing a momentum of fluid exchanged from a pressure side of the rotor blade to a suction side of the rotor blade.

3. A method in accordance with claim 1 wherein forming at least one groove further comprises forming at least one groove in the tip plate that has a depth that is variable across the tip plate.

4. A method in accordance with claim 3 wherein forming at least one groove in the tip plate that has a depth further comprises forming at least one groove in the tip plate that is tapered from the first sidewall to the second sidewall such that the groove has a depth adjacent the first sidewall that is more than a depth of the groove adjacent the second sidewall.

5. A method in accordance with claim 1 wherein forming at least one groove further comprises forming at least one groove in the tip plate that has a depth that is substantially constant across the tip plate.

6. An airfoil for a gas turbine engine, said airfoil comprising:

a leading edge;

a trailing edge;

a tip plate extending substantially between said leading and trailing edges;

a first sidewall extending in radial span between an airfoil root and said tip plate, said first sidewall defining a pressure side of said airfoil; and a second sidewall connected to said first sidewall at said leading and trailing edges, said second sidewall extending in radial span between the airfoil root and said tip plate, said second sidewall defining a suction side of said airfoil, said tip plate comprising at least one groove extending substantially between said first and second sidewalls.

7. An airfoil in accordance with claim 6 wherein said tip plate groove configured to transfer fluid from said pressure side of said airfoil to said suction side of said airfoil.

8. An airfoil in accordance with claim 7 wherein said tip plate groove further configured to facilitate increasing streamwise momentum exchange as a result of fluid passing from said pressure side to said suction side.

9. An airfoil in accordance with claim 6 wherein said airfoil has a blade chord extending between said leading and trailing edges, said tip plate groove configured to alter leakage flow distribution along said blade chord.

10. An airfoil in accordance with claim 6 wherein said tip plate groove comprises at least two identical grooves, adjacent said grooves substantially parallel.

11. An airfoil in accordance with claim 6 wherein said groove defines a depth, said groove depth substantially constant between said first and second sidewalls.

12. An airfoil in accordance with claim 6 wherein said groove defines a depth, said groove depth variable between said first and second sidewalls.

13. An airfoil in accordance with claim 12 wherein said groove tapered such that a first depth adjacent said first sidewall more than a second depth adjacent said second sidewall.

14. An airfoil in accordance with claim 13 wherein said groove substantially flush with said tip plate adjacent said second sidewall.

15. A gas turbine engine comprising a plurality of rotor blades, each said rotor blade comprising an airfoil comprising a leading edge, a trailing edge, a first sidewall, a second sidewall, and a tip plate, said airfoil first and second sidewalls connected chordwise at said leading and trailing edges, said tip plate extending substantially between said leading and trailing edges, said first and second sidewalls extending radially from a blade root to said tip plate, said tip plate comprising a groove extending substantially between said airfoil first and second sidewalls, said groove for transferring fluid from said first sidewall to said second sidewall.

16. A gas turbine engine in accordance with claim 15 wherein each said rotor blade airfoil first sidewall is concave and defines a pressure side of each said rotor blade, each said rotor blade airfoil second sidewall is convex and defines a suction side of each said rotor blade.

17. A gas turbine engine in accordance with claim 16 wherein each said airfoil tip plate groove defines a depth, each said tip plate groove configured to facilitate increasing the streamwise momentum of fluid passing therethrough.

18. A gas turbine engine in accordance with claim 17 wherein at least one said airfoil tip plate groove depth variable between said airfoil first and second sidewalls.

19. A gas turbine engine in accordance with claim 17 wherein said plurality of rotor blades identical.

20. A gas turbine engine in accordance with claim 17 wherein at least one airfoil tip plate groove tapered between said first and second sidewalls, such that adjacent said first sidewall said groove has a first depth that is more than a second depth of said groove adjacent said second sidewall.

* * * * *